United States Patent [19]

Ting

[11] Patent Number: 4,782,846

[45] Date of Patent: Nov. 8, 1988

[54] FOOTING SUPPORT FOR SECUREMENT OF TENT

[76] Inventor: Lawrence S. Ting, Hwa S. Rd., Taipei, Taiwan

[21] Appl. No.: 930,649

[22] Filed: Nov. 13, 1986

[51] Int. Cl.[4] ..... E04H 15/32; E04H 15/62

[52] U.S. Cl. ..... 135/120; 135/118; 135/DIG. 9

[58] Field of Search ..... 135/120, 119, 118, 103, 135/104, DIG. 9, 105; 52/155, 162

[56] References Cited

U.S. PATENT DOCUMENTS

| | | | |
|---|---|---|---|
| 528,394 | 10/1894 | Rinn | 135/120 |
| 2,120,180 | 6/1938 | Hungrige | 135/118 X |
| 2,185,629 | 1/1940 | Dixon | 135/118 X |
| 2,543,684 | 2/1951 | Blanchard | 135/104 X |
| 2,989,967 | 6/1961 | Lee | 135/120 X |
| 3,058,480 | 10/1962 | Blanchard | 135/105 X |
| 3,114,377 | 12/1963 | Clement | 135/120 X |
| 3,655,160 | 4/1972 | Grillot | 52/155 X |
| 3,656,212 | 4/1972 | Velte | 135/119 X |
| 4,029,117 | 6/1977 | Rain | 135/120 X |
| 4,086,931 | 5/1978 | Hall | 135/118 X |
| 4,148,332 | 4/1979 | Huddle | 135/104 X |
| 4,491,141 | 1/1985 | Eppenbach | 135/104 |

FOREIGN PATENT DOCUMENTS

| | | | |
|---|---|---|---|
| 3127110 | 2/1983 | Fed. Rep. of Germany | 135/DIG. 9 |
| 589458 | 3/1959 | Italy | 135/104 |

*Primary Examiner*—Robert A. Hafer
*Assistant Examiner*—D. Neal Muir
*Attorney, Agent, or Firm*—Trexler, Bushnell, Giangiorgi & Blackstone, Ltd.

[57] ABSTRACT

A plastics foot supporting member, adapted for mounting directly to a camping tent, comprises a horizontal sheet portion and an upright sheet portion, the two portions being held perpendicular to each other. One end of the horizontal portion is provided near the edge with a hole for tent peg to pass through. Adjacent to this hole is a vertically upwardly projecting tubular support for insertion and fixing therein of the tent brace pole. A further hole defined on the upright portion facilitates tying thereto of the tent outer sheet whereas a flaplock part formed at the tail end of the upright portion is intended to be sewn on to the corners of the tent inner sheet.

2 Claims, 2 Drawing Sheets

FOOTING SUPPORT FOR SECUREMENT OF TENT

BACKGROUND OF THE INVENTION

The invention relates to construction of a footing joint and, more particularly, to a multipurpose foot supporting means adapted to be sewn on to the corners of a camping tent for use in supporting of a tent peg or pin to pass therethrough, in setting up and holding in position of the tent brace poles and tying thereto of the guy ropes. The foot supporting means comprises an upright sheet portion to be sewn on to the corner of a tent, a horizontal circular portion for tent peg or pin to pass through for support, an upright tubular portion for erecting therein of a tent brace pole and an upright circular portion for tying thereto of a guy rope from the tent outer sheet, all said portions being formed integrally with each other.

At present, one type of handy camping tents utilizing fiberglass rod as brace poles and waterproof nylon material as tent canopy or tent awning has been used in large number, wherein corners of the tent inner and outer sheets are respectively sewn on with cord grommets which must be separately fastened to the ground by hammering with tent pins, and terminal ends of the fiberglass rods are then placed separately inside the several metal grommets being fastened to the ground. Therefore, with such a construction, it still renders the work on setting up of a tent trivial and frequently, an inexperienced hand has to spend a little time in pottering about before he can set up a tent readily and quickly. In addition, as too many scattered assembly parts tend to get lost easily, it has become necessary for a camper to always keep reserve parts for moment of need.

SUMMARY OF THE INVENTION

In view of the afore-said inconveniences with the conventional camping tents, a novel foot supporting means is devised for use with tents in accordance with the principles of the present invention.

Accordingly, the principal object of the invention is to provide a foot supporting means adapted to be mounted directly to a camping tent and having several fixing loops and seats.

A further object of the invention is to provide a tent corner device most advantageous to the tent erection work.

A still further object of the invention is to provide an element device whereby scatter and loss of the assembly parts can be avoided and the number of tent assembly parts can be minimized.

These and other objects of the present invention will become more apparent during the course of the following detailed description and appended claims.

The invention may best be understood with reference to the accompanying drawings, wherein an illustrative embodiment is shown.

THE DRAWINGS

DETAILED DESCRIPTION OF THE ILLUSTRATED EMBODIMENT

Figure 1:
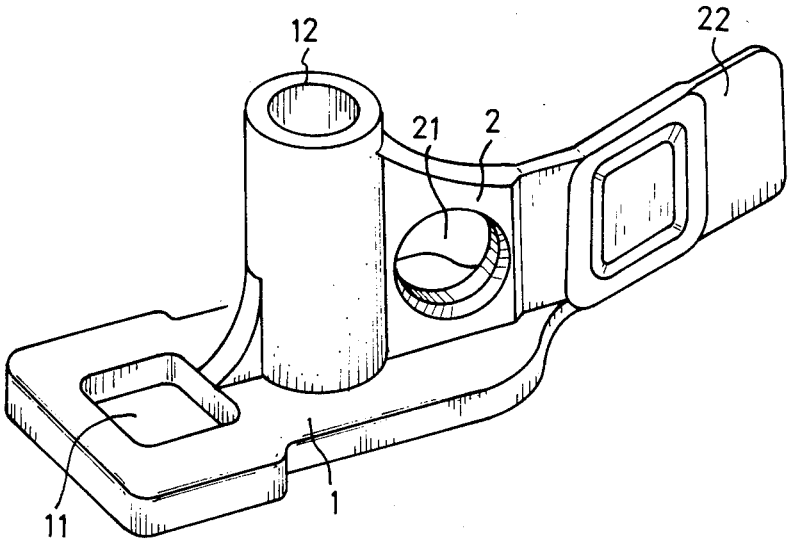
FIG. 1 is a perspective view of a tent footing support construction embodying the principles of the present invention.
Figure 2:
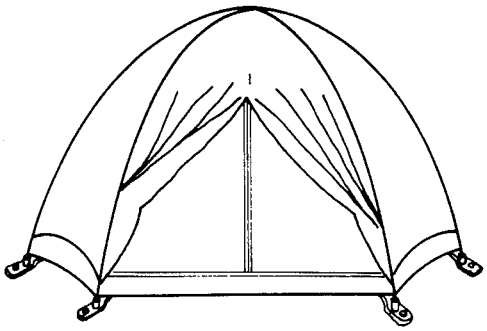
FIG. 2 shows the embodiment of the tent footing support of FIG. 1.

As shown in FIG. 1, the tent foot supporting means of the present invention is a single body structure integrally formed of plastic material comprising a horizontal sheet portion 1 and an upright sheet portion 2 with one portion being perpendicular to the other. One end of the horizontal sheet portion 1 is rounded at the edge thereof and is provided near the edge with a round hole 11. Adjacent to the round hole 11 there is formed a vertically upwardly projecting tubular portion 12 open at the top and the other side of the tubular portion 12 is joined to the upright sheet portion 2. On the upright sheet portion 2 close to the tubular portion 12 there is defined an elongated hole 21 with rounded ends. The upwardly slanting tail portion of the outside end of upright sheet portion 2 forms a flap portion 22.

Figure 3:
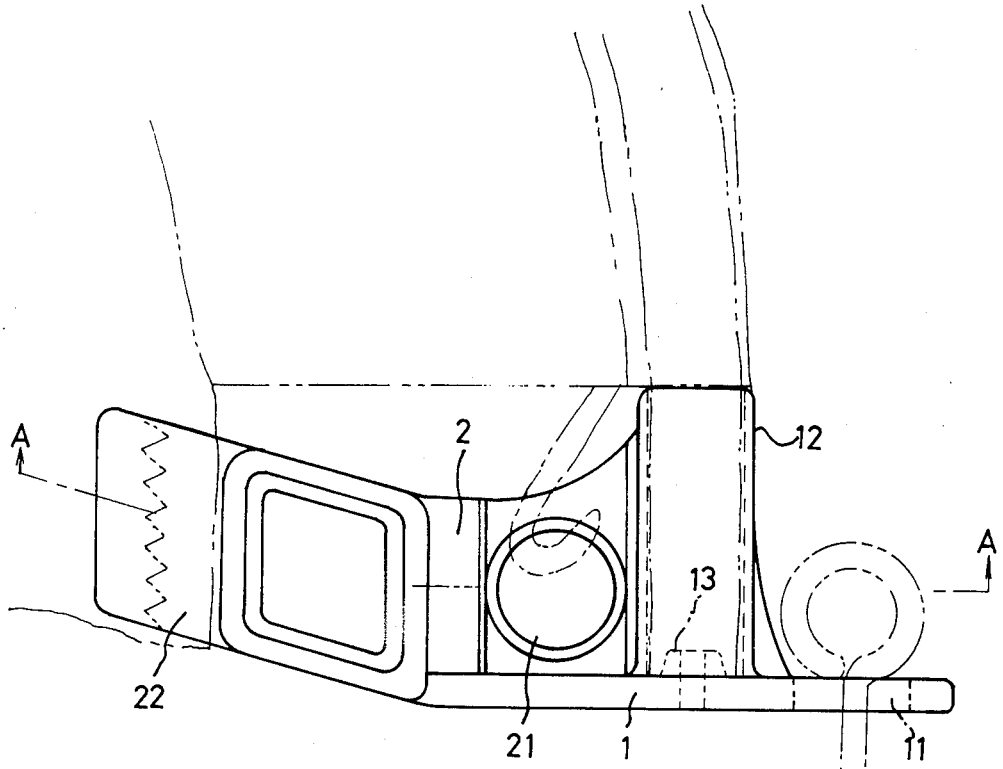
FIG. 3 is a side view of the tent footing support.
Figure 4:
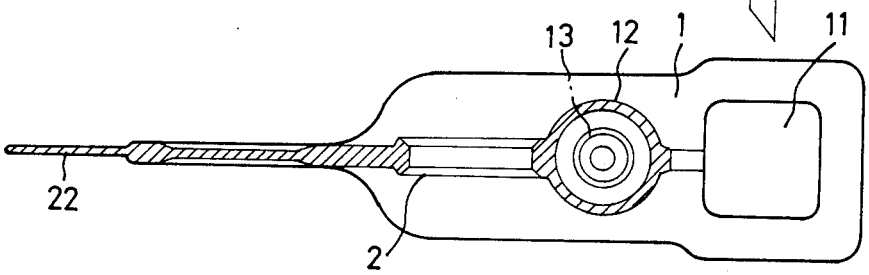
FIG. 4 is a top view of the tent footing support.

It will be understood that the flap portion 22 of the foot supporting means can be sewn on directly to each corner place of the inner sheet of the camping tent as shown in FIG. 3 and can thus combine with the latter to form a single unit. During erection of a camping tent, the terminal parts of the fiberglass poles are inserted separately in each tubular portion 12 of the foot supporting means mounted to each of the corners of the tent. Following this erection, the fiberglass poles will prop up the tent and when the tent pegs or pins are next passed through the round hole 11 each and hammered into the ground, each of the corners of the tent inner sheet will be firmly located on the ground surface. The entire setting up of the camping tent is then complete after the tent inner sheet is covered over with an outer sheet and each of the corners of the outer sheet is tied by means of a cord to or hooked on by a hook into the hole 21 of the foot supporting means.

It can be appreciated from the above detailed description and the way of setting up of a tent that with the foot supporting means of the present invention, all that a camper has to do in tent erection work is just to concentrate one's work on the means mounted in each of the corners of the tent thereby simplifying the erection work and also accelerating the setting up. Because of the multiunit construction in this footing supporting means which, at the same time, is sewn on to the camping tent, there can be no worry of the accidental loss or falling in scatter of the tent parts during the setting up or the striking of a camp and which can thus be avoided. The integrally formed multiunit construction further lowers the cost of production of the assembly parts. Hence, the novel structure of this tent foot supporting means may thus prove to be highly practically useful.

I claim:

1. A foot supporting means for use with a camping tent comprising an elongated horizontal sheet portion, an upright sheet portion integral with and perpendicular to said horizontal sheet portion extending in a direction of elongation of said elongated horizontal sheet portion, and an upwardly opening tubular support disposed substantially centrally of said horizontal sheet portion, said tubular support being for receipt of a tent pole, said upright sheet portion being joined to and terminating at said tubular support, said tubular support and said upright sheet portion being of substantially the same height, said horizontal sheet portion having a predetermined transverse dimension, said upright sheet portion having an end opposite said tubular support, and said horizontal sheet portion having an end substantially at said end of said upright sheet portion, said upright sheet portion having a flap extending beyond said end of said upright sheet portion and adapted to be sewn onto a corner of a tent inner sheet, said horizontal sheet portion having an opening disposed on an end beyond said tubular support opposite from said upright sheet portion, said opening having a width which is a substantial portion of said transverse dimension of said horizontal sheet portion, said opening being for receipt of a tent ground engaging member, and said upright sheet portion having a hole, said hole being a substantial portion of the height of said sheet portion, said hole being for receipt of fastening means such as a cord to anchor an outer sheet of a tent.

2. A foot supporting means as set forth in claim 1 and further including a boss within said tubular support, said boss upstanding from said horizontal sheet portion.

* * * * *

UNITED STATES PATENT AND TRADEMARK OFFICE

CERTIFICATE OF CORRECTION

PATENT NO. : 4,782,846

DATED : November 8, 1988

INVENTOR(S) : Lawrence S. Ting

It is certified that error appears in the above-identified patent and that said Letters Patent is hereby corrected as shown below:

On the Title Page, at Item [76],

Please change inventor's address as follows:

--8th Floor, No. 3, Tun Hwa South Road, Taipei, Taiwan, R.O.C.--

Signed and Sealed this

Twenty-second Day of August, 1989

*Attest:*

DONALD J. QUIGG

*Attesting Officer*

*Commissioner of Patents and Trademarks*